United States Patent [19]

Theault

[11] 3,978,635

[45] Sept. 7, 1976

[54] SELF-SUPPORTING ELEMENT FOR ROOF STRUCTURES AND COMBINATIONS THEREOF

[76] Inventor: Yves Theault, 51, rue de Bellevue, 14 - Caen, France

[22] Filed: Sept. 17, 1973

[21] Appl. No.: 398,170

[30] Foreign Application Priority Data

Sept. 19, 1972 France ..... 72.33094

[52] U.S. Cl. ..... 52/693; 52/18; 52/200; 52/730; 52/643

[51] Int. Cl.[2] ..... E04C 3/02

[58] Field of Search ..... 52/18, 200, 637, 648, 52/650, 690, 693, 730, 731, 86, 87, 537, 52/262, 643, 692

[56] References Cited

UNITED STATES PATENTS

| | | | |
|---|---|---|---|
| 2,007,898 | 7/1935 | Ragsdale | 52/692 |
| 2,186,297 | 1/1940 | Hunnebeck | 52/18 |
| 3,104,454 | 9/1963 | Handley et al. | 52/648 X |
| 3,345,792 | 10/1967 | Chandler | 52/648 |
| 3,443,348 | 5/1969 | Papayoti | 52/648 X |
| 3,553,914 | 1/1971 | Van Den Boorn | 52/200 |

FOREIGN PATENTS OR APPLICATIONS

| | | | |
|---|---|---|---|
| 812,465 | 8/1951 | Germany | 52/693 |

*Primary Examiner*—Ernest R. Purser
*Assistant Examiner*—Carl D. Friedman
*Attorney, Agent, or Firm*—Johnston, Keil, Thompson & Shurtleff

[57] ABSTRACT

A self-supporting structural element and combinations of such elements in roof structures are provided in which each element has an upper beam and two side truss members formed by paired upper and lower longitudinal profiled ribs joined by the tie and strut members of a lattice framework, preferably exhibiting a trapezoidal cross section, and in which a plurality of the structural elements are joined in parallel relationship along the lower rib members. These structural elements are especially useful when combined into special roof structures for industrial, school or sport buildings.

8 Claims, 5 Drawing Figures

SELF-SUPPORTING ELEMENT FOR ROOF STRUCTURES AND COMBINATIONS THEREOF

Figure 1:
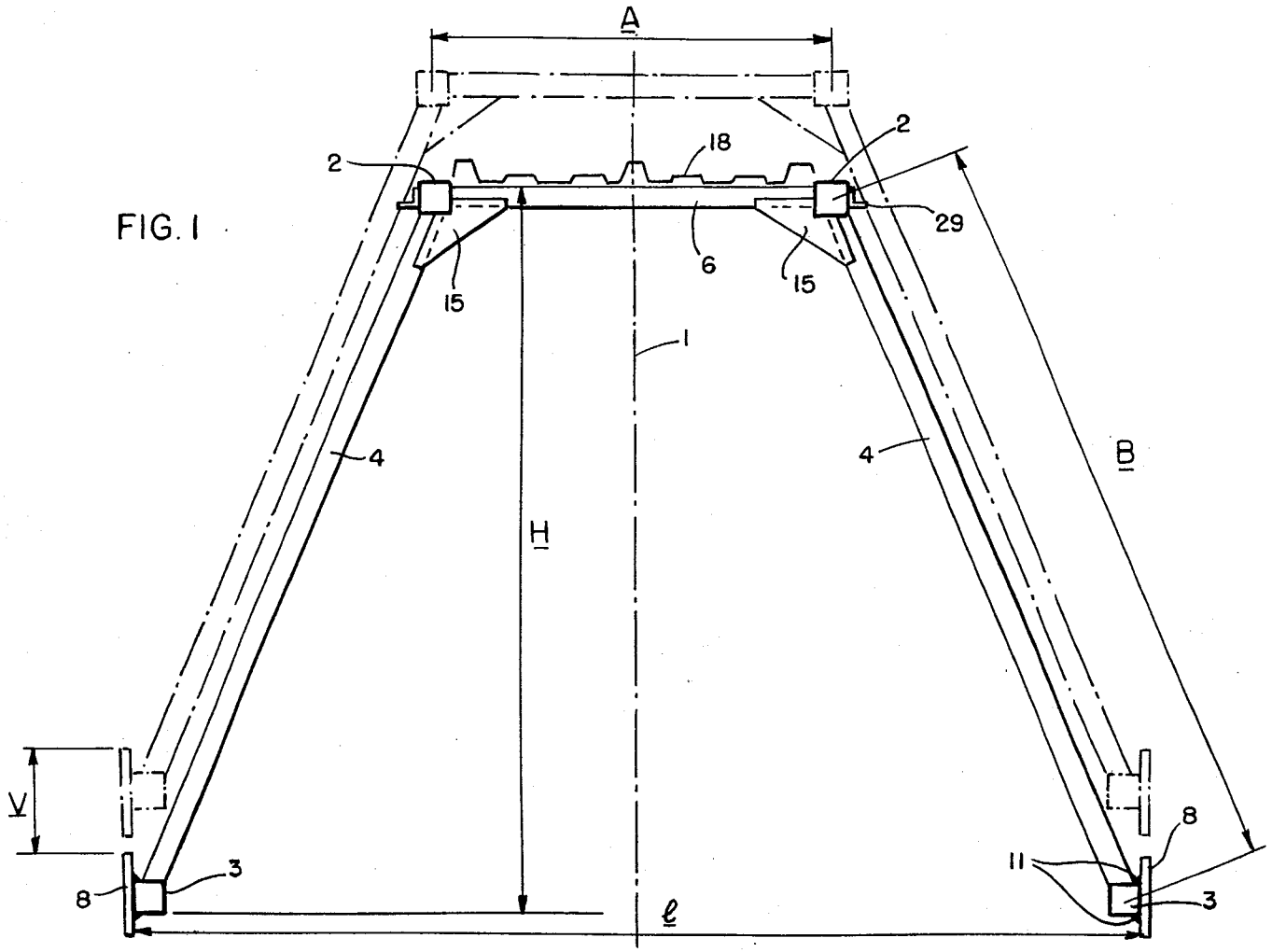

The present invention relates to self-supporting structural elements as a roof covering, especially for industrial, school and sports buildings where long spans are desirable. More particularly, the invention concerns a building roof obtained by joining a plurality of said structural elements parallel to one another and in juxtaposition along abutting longitudinal edges.

In the course of the past ten years, there has appeared a new technique for the construction of building roofs, which consists in joining several longitudinal self-supporting elements having an identical length and cross section, each of said elements resting at least with its two opposite ends on a rigid horizontal superstructure which is either a metallic structure or is composed of reinforced concrete, masonry or similar wall materials.

Thus, there have been suggested structural elements consisting of several longitudinally profiled ribs joined two by two at least by means of flat or of corrugated pieces of sheet metal. Such elements, however, because of their insufficient mechanical characteristics have been of limited size and span, so that the construction of a roof for a very long building, e.g. a span of close to 25 meters as often required, resulted in the need to insert additional vertical supporting posts at intervals along the span.

It was then suggested to use longitudinal roof elements with a length corresponding to that of the building to be erected, i.e. truly self-supporting roof elements, each being composed of a shell with an isosceles trapezoidal cross section wherein the summit is formed by the small base of the trapezoid with the shell being stiffened at intervals by means of transverse profiles welded to the internal face of the shell. A particularly advantageous use of these roof elements has been the integration internally of the shell, of various devices for heating, lighting and insulation, thus conferring a multiplicity of functions to the building roof executed in this way. There are, however, numerous drawbacks for such executions of a roof with respect to the very structure of each one of the roof elements:

a. the presence of a solid shell, especially stiffened at intervals by means of transverse profiles, requires the use of an excess of metal, the uselessness of this excess being made more serious by the fact that the load of the roof to be supported is appreciably increased, thereby leading to an increase in the cost as well as an increase the power required of the lifting apparatus at the construction site for setting the roof into place on the superstructure;

b. the natural lighting of the building through openings in such a roof is insufficient, even omitted, as a result of the difficulty in managing openings in the inclined surfaces of the elements of the structure, and also because of the narrowness of these openings at the level of which the mechanical properties of the thus pierced element are further weakened.

c. the self-supporting shell is carried externally, i.e. it is directly subjected to the actions of atmospheric agents, a fact which requires that it first be treated to resist all corrosion or that it be made of a material which resists any form of atmospheric corrosion such as special steels, alloys or the like.

The object of the present invention is to prevent the abovementioned drawbacks and, to this end, a self-supporting structural element for a roof of a building is to be provided according to a particular assembly of profiled members which, first of all, makes it possible for the element to be self-supporting while formed from a minimum quantity of metal essentially placed only in the upper and in the lower part of each structural element. This makes it possible to then execute a large number of openings which are of satisfactory size, so that the building can be lighted from outside, e.g. from the sky, through the roof covering thus provided. Finally, the structural element of the invention makes possible a simpler and more effective protection of the self-supporting parts of each element with respect to the corrosive effect of air or other atmospheric agents.

In accordance with the invention, a new industrial product is provided in the form of a self-supporting structural element for a building roof, especially for industrial, school or sports buildings, said element being adapted to rest by at least each one of its two opposite ends on a rigid horizontal superstructure, and said element including at least four profiled longitudinal ribs extending horizontally and being disposed symmetrically two by two with respect to a vertical longitudinal plane of symmetry, the two upper ribs on the one hand and each pair of ribs on the same side of said plane of symmetry on the other hand being joined by lattice framework means to provide an upper beam and two side trusses, respectively.

In one preferred embodiment, the four ribs of each self-supporting element are assembled to form, in cross section, the apexes of an isosceles trapezoid in which the small base is defined by the two upper ribs. The element may include in its upper part, between the two horizontal ribs, at least one light well means for the natural lighting of a building covered or roofed over with said element. The light well preferably includes, in addition to vertical wall members which constitute its border or mounting frame, a plurality of parallel plates, bars, strips or the like positioned within the well or frame as a sun-protection device and being slightly inclined with respect to the vertical direction, preferably covered with a transparent horizontal porthole or similar window means either in a fixed or movable relationship.

The internal faces of each of the two side trusses of the self-supporting element and preferably also the internal face of the upper beam formed by the two upper ribs, joined by the lattice framework in each instance, e.g. suitable ties and struts, may further be covered with padding means, e.g. for the purpose of providing a thermal and/or acoustical insulation or for protection against fire. The self-supporting element can also include at least one artificial lighting device containing at least one light source, preferably placed at the upper part of the element. This structural element advantageously includes at least one heating device, preferably placed approximately in its lower part, e.g. just above or below the lower rib positions. The heating device is preferably a duct or tubular sheath for the circulation of a hot fluid with an attached radiating panel.

The longitudinal profiled ribs and the lattice framework members, i.e. ties, braces, struts or the like, are preferably tubular, and at least one duct formed by such a tubular member can be placed into a circuit of fluid under pressure, e.g. in order to prevent the framework from becoming deformed. The external face of the upper beam is finally provided with a cover of sheet metal or equivalent roofing material, the width of which is approximately that of the upper beam of the self-supporting element. Each horizontal lower rib should have joining means for uniting one self-supporting element with a second self-supporting element which is also adapted to rest on the horizontal rigid superstructure in a position parallel to and juxtaposed with respect to the first element.

The present invention further provides a new industrial product which is essentially a roof or cover assembly for a building as obtained by joining together several of the above-mentioned self-supporting structural elements, especially characterized by the fact that the roof or cover includes between the upper beams of two joined adjacent structural elements an additional sheet metal cover having a width approximately equal to the interval which exists between two successive upper beams of the adjacent elements. This roof or cover assembly preferably includes, at least in one space formed between the two facing side trusses of two adjacent joined structural elements and the additional cover, means for conveying a fluid such as a fan or an air extractor or a pump for the transportation of the fluid. The fluid may be air or it may also be in the form of heat exchange liquids or vapors.

It can be seen that the advantages of the self-supporting element according to the present invention and also the roof made therefrom are numerous, and among them it is possible to mention the omission of the transverse stiffening or reinforcing profiles and the avoidance of a solid trapezoid-shaped shell, both of which permit the roof element under consideration to be much lighter. Also, special treatment of the shell so that it will resist atmospheric agents is no longer necessary. The possibility of obtaining good lighting, either natural or artificial, of the covered building and the possibility of making use of the empty space which exists between two joined adjacent elements, either for a renewal of the hot or cold air inside the building or for the transportation of a fluid, represent further advantages. Smoke or other vapors, even in the case of fire, may be more readily eliminated through the light well or skylight window or porthole.

Figure 2:
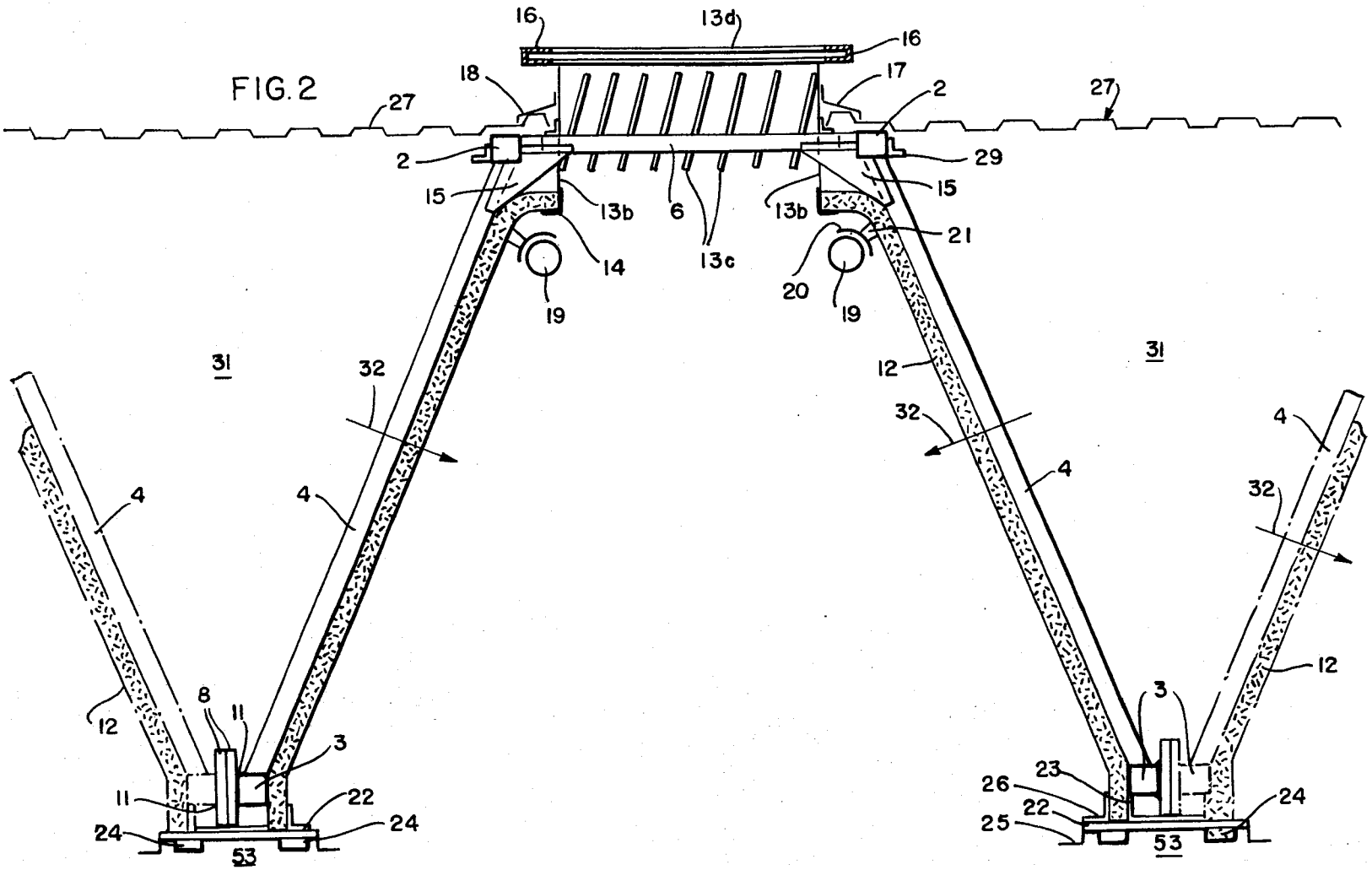

In order to better understand the present invention, there is described hereinafter by way of example only, i.e. which is not limitative but only an illustration, one preferred embodiment as shown in the attached drawings wherein:

FIG. 1 is a partly schematic cross section of a self-supporting structural element according to the present invention, surmounted with an identical element shown in phantom to indicate the mode of storage and of transportation, either by rail or by truck, of a group of elements regularly piled up or stacked on top of one another;

FIG. 2 is a cross section view of a self-supporting structural element according to the present invention, completed by the whole complex of the members, parts or devices which confer upon it a multiplicity of functions, said structural element being connected in sequence with similar elements which are only partially represented, the spaces defined between the facing sides of two adjacent elements being limited or enclosed in the upper part by means of a complementary or additional cover made of corrugated sheet metal.

Figure 3:
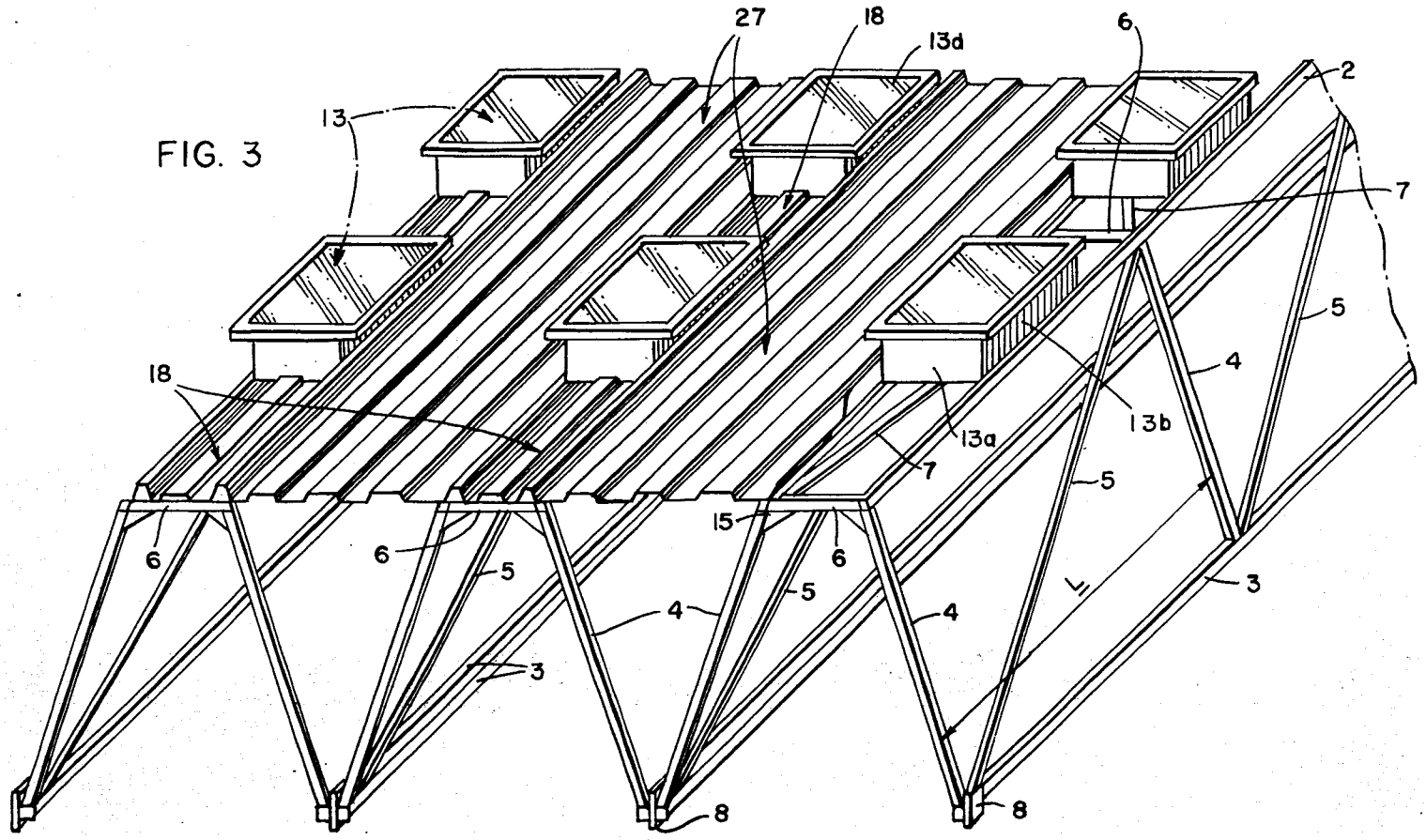
Figure 4:
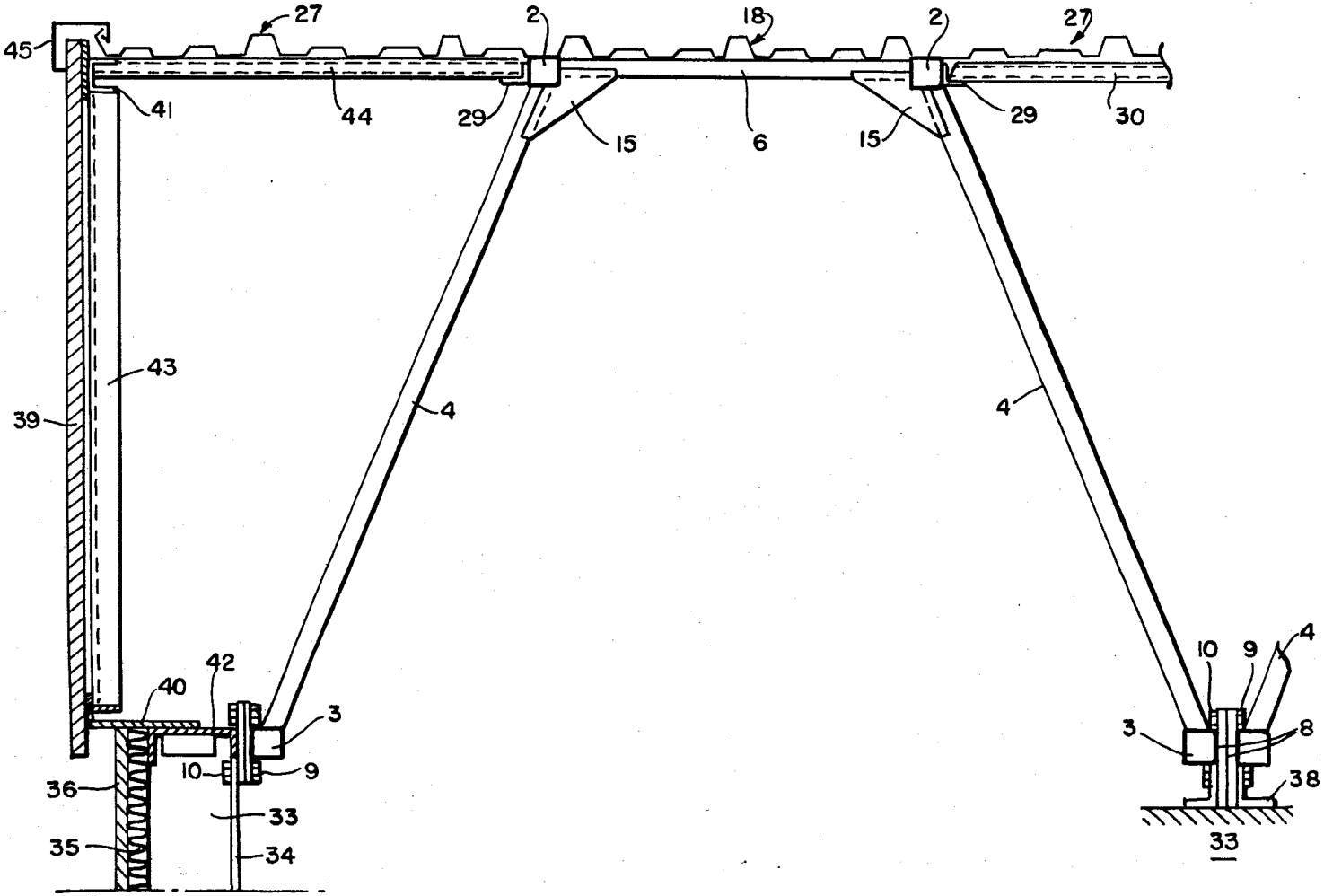
Figure 5:
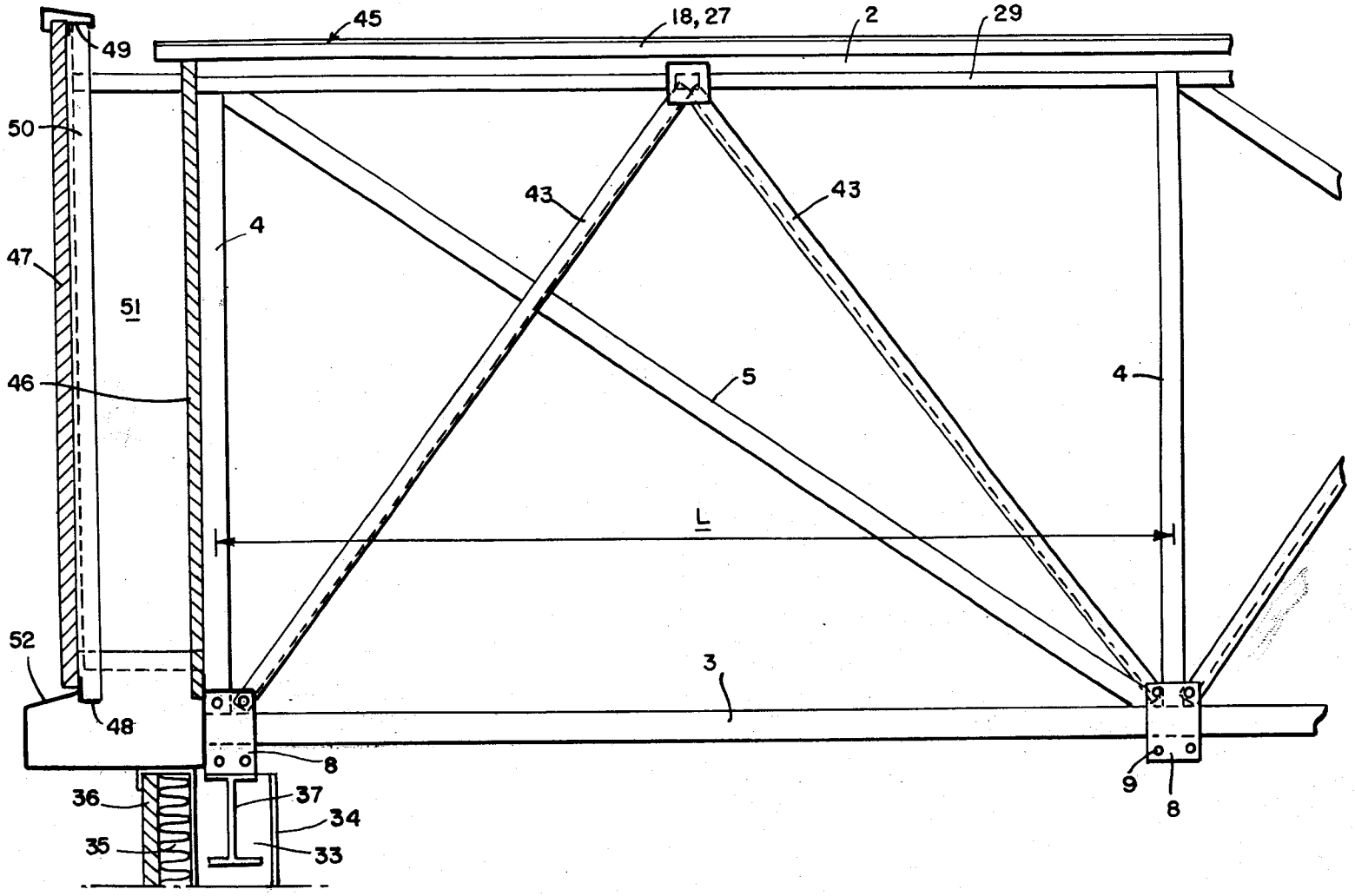

FIG. 3 is a partly schematic perspective view of three self-supporting elements placed in a parallel and juxtaposed position with respect to one another and joined by their longitudinal edges, the upper beams of the left-side element and of the central element being fitted with a sheet metal cover and the upper beam to the right being left open in order to view the lattice framework or truss members joining the ribs in pairs, thereby making structural elements of the roof very rigid and self-supporting;

FIG. 4 is a cross section view, which schematically represents a self-supporting element according to the present invention as it covers the lateral edge of a building with a simple roof finishing end member or clapboard connected thereto; and FIG. 5 is a side elevational view of a self-supporting element according to the invention to show supporting members for the lateral clapboard seen in FIG. 4, as well as to show the transverse roof finishing member or clapboard which hides the whole assembly constituted by the longitudinal ribs joined to one another in the parallel direction in the construction of a building roof or cover.

The self-supporting element of a roof for a building is represented in FIG. 1 as a cross section in its most elementary structure. It includes four horizontal profiled ribs, tubes or rods 2 and 3 which extend longitudinally and are arranged symmetrically two by two, i.e. in pairs, with respect to a vertical longitudinal plane of symmetry 1, thereby preferably forming the apexes of an isosceles trapezoid, the large base or lower part of which is defined by the two low ribs 3. The two high ribs 2 on the one hand and each pair of frame members 2,3 located on the same side of the plane of symmetry 1 on the other hand are joined together by means of a lattice framework or individual truss or beam members. This results in a structural element having an upper beam, formed by two upper ribs joined by a first lattice framework, and two lateral or side trusses, each being formed by an upper rib 2 and a lower rib 3 and being reinforced by a second lattice framework. These frameworks of the side trusses and upper beams preferably consist of profiled tie or strut members which are positioned perpendicular or diagonal to the elongated ribs 2 and 3. Thus, a side truss successively exhibits a transverse member 4 and then another member 5 placed on the diagonal. The upper beam likewise has in succession a transverse member 6 and then a diagonal member 7. Other tying or bracing members may also be employed in the lattice framework but a lightweight and open lattice construction is generally preferred.

As a specific example, each rib or tube 2 and 3 may consist of a square tubular cross section with sides of 60 mm. and a wall thickness of 3.2 mm., the rib or tube extending over a length equal to the length of the roof of the building being covered. Each profiled framework member 4, 5, 6 and 7 also has a square cross section with sides of 45 mm. and a material thickness of 2.7 mm. Before being joined into the lattice framework, the ribs 2 and 3 are placed so that after being assembled they each present two horizontal faces and two vertical faces. The external vertical faces of the lower ribs 3 are then fitted with means for joining them with a second identical self-supporting element which is also adapted to be placed on the underlying rigid horizontal superstructure of the building. Each structural element is thus firmly connected parallel to and juxtaposed with said first element. The joining means for connecting two adjacent self-supporting elements may, for example, consist of the connection tabs 8 which are 10 mm. in thickness and 150 mm. in height, extending above and below rib 3 and having perforations or openings for the introduction of suitable fastening means, for example bolts 9 with nuts 10. Generally speaking, the tabs 8 are solidly joined to ribs 3 by means of welding at lines 11, i.e. around each tab where it contacts the rib.

Of course, in the interest of aesthetics and a uniform roof structure, each self-supporting element as described above preferably has geometric and physical characteristics rigorously identical to those of the neighboring elements in a single roof assembly. By way of example, each self-supporting element of the invention as shown in the drawings can have a height H of 130 cm., measured between the uppermost horizontal face of the upper rib 2 and the lowermost horizontal face of the lower rib 3, a width *W* of 180 cm., measured between the external vertical faces of the tabs 8, a width A of 70 cm., measured between the centerlines of the opposing upper ribs or tubular members 2. According to this arrangement, the distance B in the side truss which separates the center axis of upper rib 2 from the center axis of lower rib 3 is 135 cm. Length L which separates the centerlines or axes of two successive transverse members 4 or 6 is also 180 cm. As already expressed, the length of the ribs or tubular members 2 and 3 is equal to the length of the roof of the building being constructed, i.e. on the order of magnitude of spans measuring up to about 20 to 25 meters.

For storage and transportation of the structural elements of the invention by railroad car or truck, these elements can be stacked one upon the other as indicated in FIG. 1 wherein the bottom structural element is shown in solid lines while the upper element is shown in phantom lines. In the example of dimensions of the structural element given above, the stacking results in a vertical displacement from the position of the lower element to the position of the upper element of V which is equal to 35 cm. Thus, for transportation by railroad cars where French railroad cars (S.N.C.F) have a height of 2.90 meters, it is possible to superimpose or stack five elements as discussed above in such cars.

The self-supporting element for roofs as described herein is of interest, of course, in that it is possible to add various means or devices thereto so that the element will perform multiple functions, e.g. lighting, heating, thermal and acoustical protection, air-conditioning, water-tightness and the like. The construction of a building traditionally requires as many contractors as there are different techniques of operation to fulfill such functions. Thus, while it is ordinarily necessary for several contractors to work in succession at the construction site, either before or after the roof is set in place, i.e. so as to provide all of the functions required to provide a habitable building, the present invention offers the possibility of a prefabricated roof in which all of the above-mentioned functions can be incorporated at the plant where the roof elements according to the invention are fabricated. Then, at the site of construction, this prefabricated roof in the form of the self-supporting elements having all of the desired multiple functions can be very easily assembled and installed onto any suitable horizontal superstructure. Simple side and end clapboards can then be added to the prefabricated and installed roof to ensure a finished appearance. Where the main characteristic of the roof elements according to invention is to provide these multiple functions, the lower foundation and superstructure of the building can be first erected in a relatively simple manner and at low cost, after which the building is made completely functional and ready for occupancy or use by rapidly topping it off with the prefabricated roof.

First, referring to FIG. 2, the internal elongated faces of each of the two inclined side trusses 4 and also the upper beam 6 of the structural element of the invention is covered with a padding 12 for thermal insulation, acoustical insulation and/or protection against fire. For example, the padding or panel 12 may be formed by a shell or sheet composed of plaster, vermiculite or the like of about 40 mm. in thickness, preferably selecting a material or composition which will resist fire for at least one and one-half hours and which also ensures a thermal and sound insulation of the side and upper lattice frameworks.

Light wells or skylights 13 are desirably installed in the upper part of the self-supporting element, i.e. between the two horizontally extending ribs or tubular members 2 so as to provide natural lighting for the building. In order to maintain the modular character of the structural element, the skylights are preferably positioned at intervals every 1.80 meters along the length of the element. Note both FIG. 2 and FIG. 3. Each skylight includes two transverse vertical walls 13*a*, which are 80 cm. apart, and two longitudinal vertical walls 13*b*, which are 50 cm. apart. These walls 13*a* and 13*b* extend completely through the padding or insulation members 12 and, advantageously, are equipped at their lower end with a knee-piece or squared flange 14 which extends in a horizontal direction as a support for the pad 12. The longitudinal side walls 13*b* especially need this flange while simultaneously resting on the tubular members 2 or being fastened thereto, if desired, with a second horizontal flange or shoulders which may also be supported by the reinforcing corner plates 15 in the event that the diagonal member 7 extend only up to the skylight where an intermediate transverse member 6 can be added adjacent the two vertical walls 13*a*. The parallel plates 13*c* act as means for sun protection, being slightly slanted or inclined from the vertical direction and extending longitudinally within the opening formed by the vertical walls of the well or skylight. The angle of inclination of these plates 13*c* with respect to the vertical is on the order of 15° and generally would not exceed 19° in a temperate latitude where the sun never rises higher than 71°. Regardless of the use of the building, whether for industrial purposes, sporting activities or school programs, it is possible and very desirable to light the building only from the celestial vault, i.e. from the diffused light of the sky while screening off direct sunlight. For protection of the interior of the building from rain and snow, the skylight is equipped at its upper end with a porthole or window frame 13*d* which may be fixed in a horizontal position or it may also be hinged or otherwise made movable with reference to the self-supporting element and the vertical walls 13*a* and/or 13*b*. The window or transparent portion of the porthole 13*d* is preferably made of "DURFLEX", "PLEXIGLAS", "LUCITE", or similar transparent acrylic sheet materials. This transparent sheet may have a thickness of approximately 6 mm. and may even be used alone without a window frame. On the other hand, the frame of the porthole or window 13*d* may be designed to tightly hold the acrylic sheet and to prevent the entrance of water or moisture by means of an air-tight peripheral seam or sealing joint 16. In addition to providing natural lighting, the portholes 13 also serve as means for the escape of smoke or fumes, e.g. in case of fire as well as exit points for industrial fumes, and it will therefore be evident that the window member 13*d* be mounted movably on one wall of the skylight. Finally, a drip flap or flashing member 17 in the form of a profiled metal sheet or stamping is welded onto the external face of the longitudinal walls 13*b* of the skylight to play the part of gutters and to avoid entry of rain water into the building.

The structural element of the invention is essentially limited to only four elongated ribs or framing tubes 2 and 3 which are then joined and reinforced by the metal skeleton or latticework of the additional ties and struts 4, 5, 6 and 7 which have the function of absorbing the vertical and horizontal stresses to which the structural element is subjected. From the standpoint of the metal being used, the self-supporting structural element is thus strictly limited to a minimum number of useful parts, i.e. the upper and lower ribs joined by the ties and struts into one upper beam and two side trusses, especially for the purpose of reducing the inertia and the mass of the roof element without weakening its mechanical properties in terms of strength and durability. A decrease in the mass or weight of the roof element obviously reduces the cost of the roof as well as permitting easier handling during prefabrication at a mass production plant, during transportation and during erection at the construction site of the building. However, the very fact that the roof element has an open skeletal or lattice structure requires that the upper beam be fitted, advantageously on its upper or external face, with a cover member 18 having the same width as the upper beam. This cover 18 is preferably made, for example, from a corrugated sheet metal of 10/10ths mm. in thickness. Other covering materials are equally useful, preferably materials which are resistant to corrosion and atmospheric conditions including aluminum and fiberglass materials as well as steel.

In order to achieve a continuous lighting function for the roof element of the invention, it should include at least one artificial lighting device, i.e. at least one electrical lighting fixture. Ideally, the artificial light source such as a fluorescent lamp 19 is mounted in the zenith or upper portion of the roof element close to the skylights 13 and on both sides thereof, each light source 19 preferably being backed by a metallic reflector 20 affixed by tabs 21 to the lattice framework.

Also, in order to confer a heating function to the roof element according to the invention, there is incorporated at least one heating device which is preferably positioned within the lower portion of the element and especially along each one of the two longitudinal edges just below or adjacent or to one side of the lower ribs 3. As one example of this installation, a horizontal plate 22 is connected by means of tabs 23 to each one of the ribs 3 with plate 22 supporting a heating sheath or conduit 24, a radiating panel or bent sheet 25 of metal which is 6/10 mm. thick and a corner piece 26 to ensure the support of the insulation pad 12 in or directly below the bottom part of the roof element.

At the construction site, after assembling a plurality of the roof elements in parallel positions, the various electric light sources 19 are connected to a current generator furnished with each building or an external power source while the various heating conduits 24 are likewise interconnected into a circuit for the circulation of a suitable heating fluid such as steam or air. These electrical connections and completion of heating circuits thus remain as the only operations to be performed at the construction site. By comparison, prior techniques have required the presence, either simultaneously or more often one after the other, of anywhere from six to ten different contractors to provide the building with all of its essential functions such as heat, light, etc.

It is also quite advantageous to connect each of the lower tubular ribs 3 with a source of water under pressure. Each tubular rib which is uni-profiled then plays the part of a duct inside of which is circulated water under a pressure of 5 to 6 kg., this evenly distributed internal pressure acting to prevent any deformation of these tubular ribs as supporting elements and also further acting as a source of water under pressure, e.g. for an automatic sprinkler system.

The main purpose of the self-supporting structural elements according to the invention, through their ability to be quickly assembled in parallel and then interconnected, is to provide a roof complete in itself by means of these elements alone after their placement on a conventional horizontal superstructure prepared in advance. Only a very few finishing steps are required with a minimum of simple assembly labor.

Thus, after completing the joining of the roof elements by tightening bolts 9 and nuts 10 of the tabs 8, it becomes necessary in a first stage to finish the roof by placing between the upper beams of each pair of adjacent roof elements, an additional cover member 27 which is preferably made of the same corrugated sheet metal as the cover 18 for reasons of aesthetics. This additional cover 27 has a width corresponding to the interval between two successive upper beams, and a plurality of these covers 27 are easily inserted to finish the top covering surface of the roof. To this end, the angles or L-shaped members 29 are welded to the external vertical faces of the upper ribs 2, the vertical arm of these angles being turned upwardly so that the horizontal arm extends outwardly as a support for the profiled members 30 which have a C-shaped cross section and are placed at intervals in the transverse direction. These C-shaped members 30 thereby serve to support the additional cover members 27. The ends of members 30 rest on the horizontal arms of angles 29 by one of their two flanks, the other flank then contacting the internal face of the additional cover 27. In keeping with the various dimensions given above for a specific embodiment of the roof element, the L-shaped angles 29 with perpendicular arms have a vertical arm of 40 mm. in width and a horizontal arm of 50 mm. in width, and the profiled C-members 30 have a base of 50 mm. in width with each flank being 40 mm. in width and a material thickness of the base and two flanks of 3 mm.

The particular embodiment suggested according to the present invention makes it possible to incorporate air-conditioning apparatus into the building, taking advantage of the space 31 enclosed by the two inclined side trusses of two adjoined roof elements and the additional cover member 27. Suitable air-conditioning apparatus includes a fan or air exhaust device and may also include means for carrying a hot or cold fluid in circulation as heat exchange means. The thermal exchange, schematically represented by arrows 32, is in fact quite feasible through the side trusses, especially where the insulating pads 12 are removed in part or entirely. In this latter case, it would be helpful to line the undersurfaces of the cover members 18 and 27 with an insulation sheet or batting (not shown). Such heat exchange between adjacent spatial zones or areas of the complete roof assembly appears to be a new function resulting from the very particular structure of each roof element according to the invention.

The supporting walls of the building are conventional and may, for example, include the upright posts or open pillars 33, identified as 130/82 I.P.E., bearing an internal facing wall 34, an external clapboard 35, an external wall 36 and the upper transverse beams 37 having an I-shaped cross section. These I-beams 37 support the ends of the self-supporting roof elements of the invention, e.g. by means of tabs 8, which in turn may be fastened to the L-shaped angles 38. No intermediate posts or pillars need be placed inside the building for supporting the roof elements of the invention, a fact which of course has the advantage of ensuring the maximum use of the building interior space. The finishing of the roof along the sides is obtained, for example, by means of a simple clapboard 38 supported on one hand at its lower end by means of a corner piece 40 held firmly on the supporting wall structure and, on the other hand, at its top end by means of a profiled member 41 with a C-shaped cross section. Corner piece 40 is fastened by any conventional means to a lid or cap member 42 having a C-shaped cross section, identified as U.P.N. 160. A side clapboard support, as achieved by means of L-shaped members 43 with arms of 40 mm. in width and 4 mm. in thickness, ensures a union between the bottom member 40 and the top member 41, said L-shaped members 43 being placed on a diagonal and extending alternately from the bottom up and from the top down, so as to maintain the aforementioned module L of 1.80 meters. In other words, the projection of each diagonal member 43 is 90 cm. Between the C-shaped member 41 and the extreme angle 29 facing it, there are inserted the C-shaped extensions 44, similar to members 30. Then, the top part which exists between the external clapboard 39 and the most external inclined side truss of the roof is covered with the same covering element 27 made of corrugated sheet metal. An end piece 45, with an approximately L-shaped cross section but with its longitudinal edges being bent inwardly, ensures a good connection and water-tightness between the external clapboard 39 and the last installed section of the cover 27 (see FIG. 4).

The transverse finishing of the roof is obtained, for example, by means of a first simple clapboard 46 (see FIG. 5) which is placed solidly on the transverse array of tubular end members 4 of the side trusses. A second external clapboard 47 is also shown in FIG. 5 and is supported, as is the side clapboard 39, by means of a bottom angle 48 together with an upper member 49 having an L-shaped or a C-shaped cross section, and also the L-shaped extensions 50 which are placed on a diagonal. A space 51 is formed by said second clapboard 47 with said first clapboard 46 leading into a gutter 52 at the lower end provided by a preformed "CORTEN" sheet metal.

Because of the particular assembly of a plurality of roof elements according to the present invention, carried out by juxtaposition of their longitudinal edges, there is advantageously a provision for heating devices and especially radiant heating means along the bottom end portion of the roof elements, such that each plate 22 will extend from one roof element to the next adjacent roof element, covering the two tabs 8. Each plate 22 then includes two conduits 24 and two radiating panels 25, the two longitudinal conduits 24 forming between them a space 53 which is 160 mm. in width, thereby being sufficiently wide to permit a useful but optional incorporation of partitions in this space.

The invention is hereby claimed as follows:

1. A self-supporting elongated structural element for supporting the roof of a building which is adapted to rest by at least each one of its two opposite ends on a rigid horizontal superstructure and which includes at least four profiled longitudinal ribs extending horizontally and being disposed symmetrically two by two sloping outwardly with respect to a vertical longitudinal plane of symmetry, the two upper ribs being united by horizontal individual beam members on the one hand and each pair of ribs on the same side of said plane of symmetry on the other hand being joined by a lattice framework means to provide an upper beam and two side trusses, respectively, the bottom being open and unobstructed so that said elements can be stacked on top of one another.

2. A structural element according to claim 1 wherein the four ribs are disposed in a manner such as to form, in cross section, the apexes of an isosceles trapezoid in which the small base is defined by the beam connecting the two upper ribs and there is no large base.

3. A structural element according to claim 1 wherein the external face of the upper beam formed by the two upper ribs joined by said lattice framework means is provided with a cover of sheet metal having the approximate width of said upper beam.

4. A structural element according to claim 1 including in its upper part, extending downwardly between the two horizontal upper ribs, at least one light well means for the natural lighting of a building covered with said element.

5. A structural element according to claim 4 wherein said light well means includes vertical wall members which constitute a mounting frame, a plurality of parallel plate members within said mounting frame as sun-protectors in slightly inclined position with respect to the vertical direction, and a horizontal porthole mounted on said frame in fixed or movable relationship.

6. A structural element according to claim 1 comprising an upper beam formed by the two upper ribs and two sloping side trusses, joined in each case by said lattice framework means, and a pad means covering the internal faces of each of said beam and said side trusses for thermal or acoustical insulation, or for protection against fire.

7. A structural element according to claim 1 wherein said profiled longitudinal ribs and the tie and strut members of the lattice framework means have a tubular construction.

8. A structural element according to claim 1 wherein each lower horizontal rib has joining means for uniting said rib with a second self-supporting structural element also adapted to rest on the rigid horizontal superstructure in a position parallel to and juxtaposed with respect to the first element.

* * * * *